US006591791B2

(12) United States Patent
De Bei

(10) Patent No.: US 6,591,791 B2
(45) Date of Patent: Jul. 15, 2003

(54) SPARK-IGNITION ROTARY INTERNAL-COMBUSTION ENGINE

(76) Inventor: Claudio De Bei, Vicolo Bonamigo, I-36061, Bassano del Grappa (IT)

( * ) Notice: Subject to any disclaimer, the term of this patent is extended or adjusted under 35 U.S.C. 154(b) by 76 days.

(21) Appl. No.: 10/019,372

(22) PCT Filed: Apr. 19, 2001

(86) PCT No.: PCT/EP01/04453

§ 371 (c)(1),
(2), (4) Date: Dec. 26, 2001

(87) PCT Pub. No.: WO01/81741

PCT Pub. Date: Nov. 1, 2001

(65) Prior Publication Data

US 2003/0070632 A1 Apr. 17, 2003

(30) Foreign Application Priority Data

Apr. 26, 2000 (IT) ..... VI00A0076

(51) Int. Cl.[7] ..... F02B 57/00
(52) U.S. Cl. ..... 123/44 R; 123/44 C; 123/44 D
(58) Field of Search ..... 123/43 R, 44 R, 123/44 C, 44 D

(56) References Cited

U.S. PATENT DOCUMENTS

| | | | | |
|---|---|---|---|---|
| 2,683,422 A | * | 7/1954 | Richards, Jr. | 123/44 R |
| 3,921,602 A | * | 11/1975 | Froumajou | 123/44 D |
| 4,040,398 A | * | 8/1977 | Billings et al. | 123/44 R |
| 5,375,564 A | * | 12/1994 | Gail | 123/44 C |
| 5,671,702 A | * | 9/1997 | Lindblad | 123/44 D |

FOREIGN PATENT DOCUMENTS

| | | | |
|---|---|---|---|
| FR | 998043 | * | 9/1951 |
| GB | 1446851 | * | 8/1976 |
| GB | 1447416 | * | 8/1976 |

* cited by examiner

*Primary Examiner*—Hoang Nguyen

(57) ABSTRACT

A spark-ignition rotary internal-combustion engine, having a plurality of pistons (7) which perform a reciprocating motion inside cylinders (6) arranged so as to be equally angularly spaced on a same circumference, the cylinders (6) being formed in a rotating body or rotor (2) which rotates coaxially inside a fixed body or stator (1), in which the inlet duct (9) for the air-fuel mix, the burnt gas exhaust duct (8) and the spark-plug recess (10) are provided.

9 Claims, 6 Drawing Sheets

SPARK-IGNITION ROTARY INTERNAL-COMBUSTION ENGINE

TECHNICAL FIELD

The invention relates to a spark-ignition rotary internal-combustion engine.

BACKGROUND ART

Among the many projects that have been presented for creating a new engine having improved characteristics with respect to the ones still presently in use, only a few have followed an innovative path which is entirely revolutionary with respect to current engines, which have now been available for over one hundred years.

In recent times, so-called rotary engines, or lobed engines and other engines of various kinds and functionalities, in which the operating cycles are similar to those of conventional engines, but in which the rod-and-crank system lacks, have been presented.

Merely as an example, mention is made of the Wankel engine, composed of two bodies arranged one inside the other so that the outer body is fixed and the inner one has a "planetary" motion which, at each rotation through 360°, generates variable-volume combustion chambers.

DISCLOSURE OF THE INVENTION

The invention consists in providing a rotary internal-combustion engine which has the same operating principles as reciprocating engines, of the two-stroke and four-stroke types, but has a rotary operation.

This aim is achieved with a rotary internal-combustion engine, characterized in that it uses a plurality of pistons having a reciprocating motion, each piston being able to slide within a cylinder in an identical spaced angular arrangement in a same circumference, where the cylinders are accommodated in appropriately provided seats formed in a rotating body or rotor which rotates coaxially inside a fixed body or stator, in which the inlet ducts for the air-fuel mix and the exhaust duct for the burnt gases are formed together with the seat for the spark-plug, as in conventional internal-combustion engines.

The surfaces between the rotor and the stator have minimal tolerances and are manufactured with a spherical surface so as to give perfect balancing to the interior of the system in rotary motion.

The rotor, which assumes the shape of a spherical sector with two flat faces, is supported by a fixed supporting shaft which is rigidly coupled to the body of the stator by using two lateral flanges which are freely keyed, by interposing bearings, on said fixed supporting shaft.

The reciprocating motion of the pistons is achieved by engaging them so that they follow over 360° the profile of a fixed eccentric element having a circular cross-section by virtue of the coupling of connecting rods, in which the big end is freely inserted in said profile of the eccentric element while the small end is inserted in the pin of the piston, the axis of said eccentric element being offset and parallel to the axis of the engine, i.e., to the axis that constitutes simultaneously both the axis of said fixed supporting shaft and the rotation axis of the rotor, within which the pistons slide with a reciprocating motion, said pistons being four or six.

In this solution, the rotor operates by turning about its own axis; clearly, the inserted cylinders, by following this rotation, force the pistons to slide within their walls, said pistons being coupled by connecting rods which are connected to the eccentric element; this produces a reciprocating rectilinear motion and cyclically varies, with a 360° period, the volume of the combustion chamber formed between the head of the piston and the head of the cylinder, constituted by the internal surface of the stator.

The eccentricity of the axis of the eccentric element with respect to the axis of the engine has such a value that it is possible to produce continuously, in each one of the combustion chambers that correspond to the pistons, a continuous variation of their volumes, thus ensuring an operation which is similar to the operation of a conventional internal-combustion engine of the four-stroke type (intake, compression, power, exhaust).

The device used by the piston to continuously follow the circular profile of the eccentric element has a connecting rod for each piston; said connecting rod is keyed at one end to said pin and at the other end to the eccentric surface, with a bearing or roller cage inserted.

The advantages of the operation of the two-stroke engine produced by the absence of the distribution mechanisms are achieved with the engine according to the invention by providing a distribution which is controlled by the rotor, during its 360° rotation, which gradually opens and closes two ports formed in the body of the stator, i.e., an inlet port for the air-fuel mix and an exhaust port for the burnt gases.

BRIEF DESCRIPTION OF THE DRAWINGS

The torque obtained by virtue of the rotation of the rotor is transferred outside the engine by keying on the hub of one of the two lateral walls of said rotor a gear which meshes with a fixed-axis pinion which is rigidly coupled to the stator and in turn rotates external power take-offs which are used for example for the operation of the starter motor, of the oil pump, of the electronic contacts, and the power take-off for traction.

These and other characteristics of the invention will become better apparent from the description of a preferred embodiment, given only by way of non-limitative example with the aid of the accompanying drawings, wherein.

WAYS OF CARRYING OUT THE INVENTION

Figure 1:
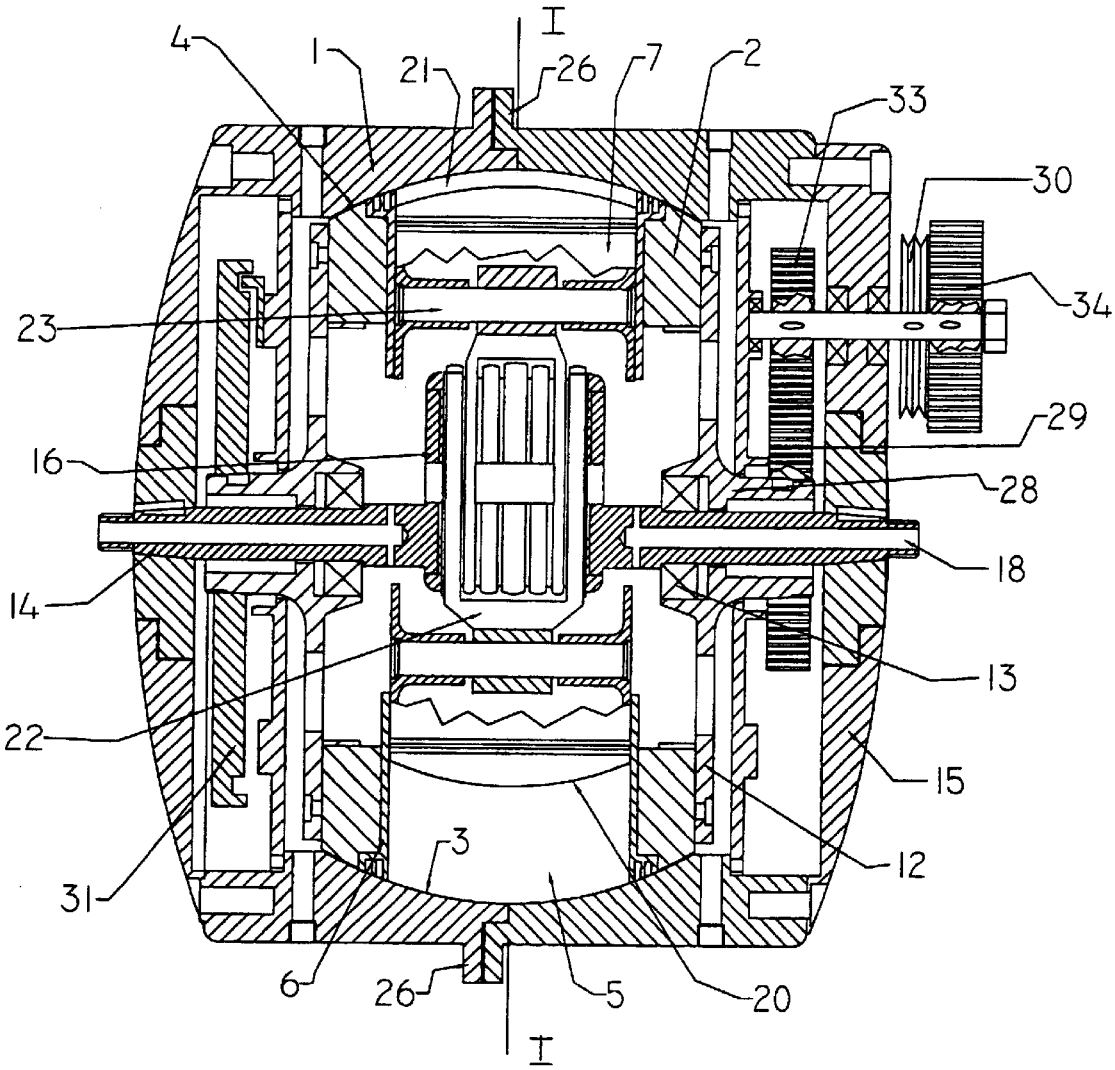
FIG. 1 is a sectional elevation view of the engine according to the invention in one of its embodiments.

As shown in the figures, the rotary internal-combustion engine according to the invention is composed of a fixed body 1 or stator inside which a movable body or rotor 2 rotates coaxially.

The regions of contact between the two bodies 1 and 2, specifically the internal surface 3 of the stator and the external surface 4 of the rotor, have a spherical profile.

In the body of the rotor 2, which is shaped like a spherical sector with two flat faces, there are four equidistant radial cavities 5 which are meant to accommodate the cylinders 6 in which four pistons 7 can respectively slide with a reciprocating rectilinear motion.

The ports 8, 9 respectively for discharging the burnt products and for aspirating the air-fuel mix, and the seat 10 for the spark-plug 11, are formed in the fixed body or stator 1.

The rotor 2 has two lateral flanges 12 which are freely supported by means of bearings 13 on a fixed shaft 14 which is coaxial and is supported by the lateral flanges 15, which are rigidly coupled to the body of the stator 1.

The fixed shaft 14 has, in its central region, an eccentric body 16 which has a circular profile and an offset axis 17 which is parallel to the central rotation axis 18 of the rotor 2.

Figure 2:
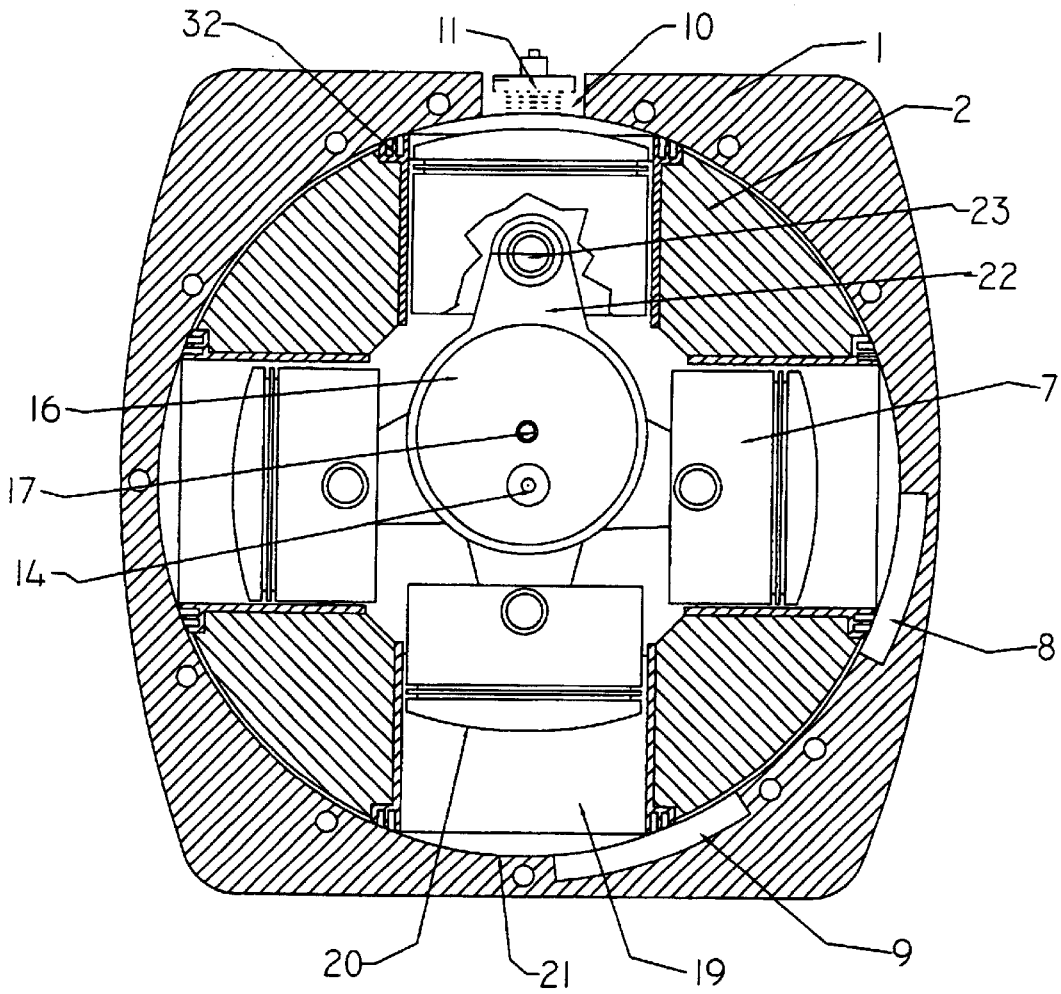
FIG. 2 is a sectional side view of the engine, taken along the line I—I of FIG. 1.
Figure 3:
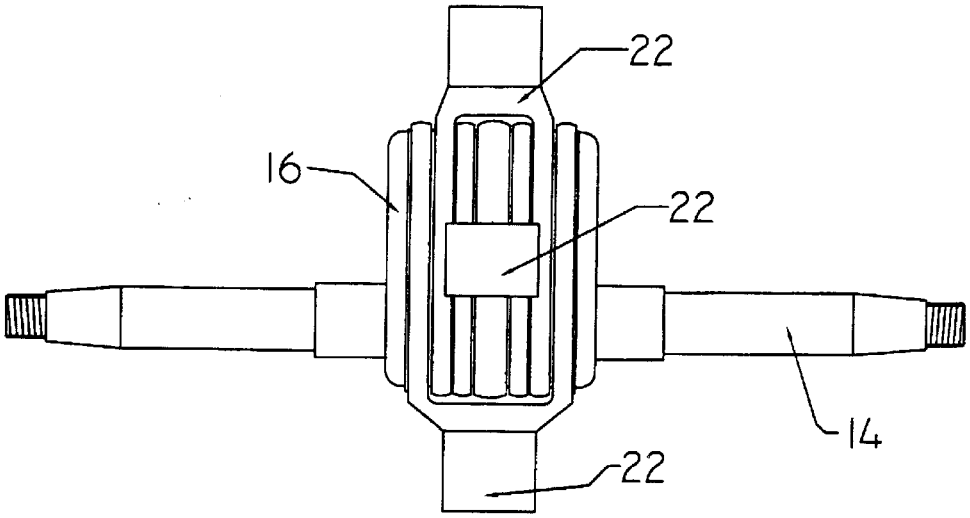
FIGS. 3 and 4 are views of the shaft assembly, with the eccentric element, the connecting rod assembly and the pistons.

As shown in FIGS. 1 and 2, the pistons are engaged so as to follow through 360° the circular profile of the eccentric element 16 by means of connecting rods 22, so that said pistons are forced to perform a reciprocating rectilinear motion inside the corresponding cylinders 6, thus varying continuously the volume of the combustion chamber 19 formed between the head of the piston 20 and the head 21 of the cylinder, constituted by the internal surface 3 of the stator 1, both of which have a spherical profile.

Figure 4:
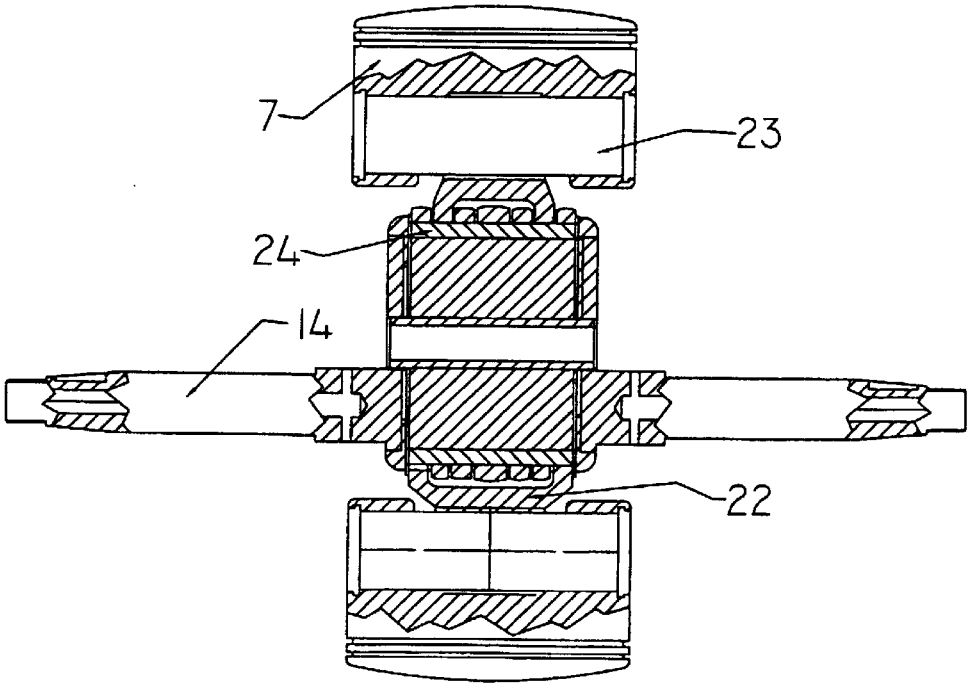

As shown specifically in FIGS. 1, 2 and 4, the method for engaging the piston so that during its 360° rotation it follows the profile of the eccentric element consists in using a connecting rod 22 which is keyed at one end to the pin 23 of the piston 7 and at the other end, freely and by way of a bearing 24, to the surface of the eccentric element 16; in this manner, the rotor, by turning through 360°, moves the piston, which being coupled to the connecting rod is forced to perform a rectilinear reciprocating motion.

FIGS. 5 to 12 illustrate constructive details related to the three elements that characterize the engine according to the invention, i.e., the fixed shaft with eccentric element, the stator, and the rotor, respectively.

Figure 5:
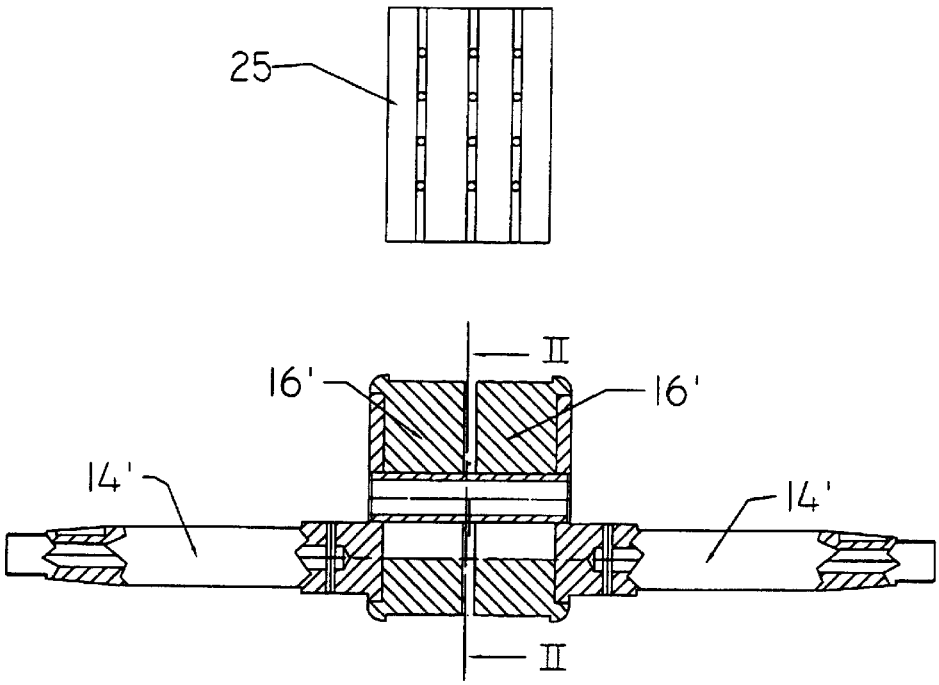
FIG. 5 is a detail view of the shaft with the eccentric element and the bearing.
Figure 6:
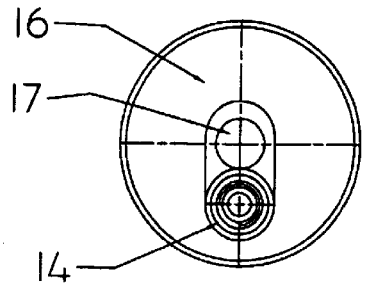
FIG. 6 is a side view of the shaft of FIG. 5.
Figure 7:
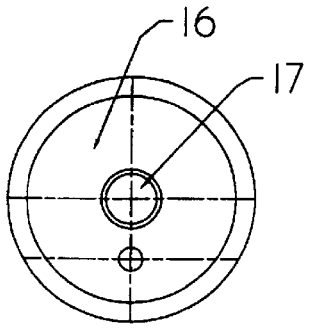
FIG. 7 is a sectional side view, taken along the line II—II of FIG. 5.

As shown in FIGS. 5 to 7, the fixed shaft with eccentric element is formed by two separate symmetrical elements, each constituted by a shaft portion 14' provided each with a eccentric element portion 16', which are separated at the central plane of the engine and are joined by way of a pin which passes through the axis 17 of the eccentric element, with a bearing 25 keyed thereto.

Figure 8:
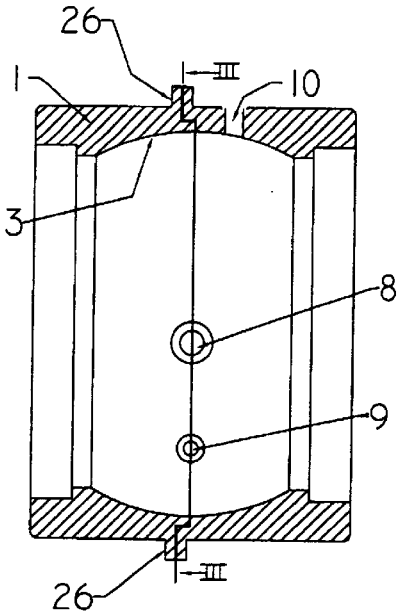
FIG. 8 is a sectional detail view of the stator.
Figure 9:
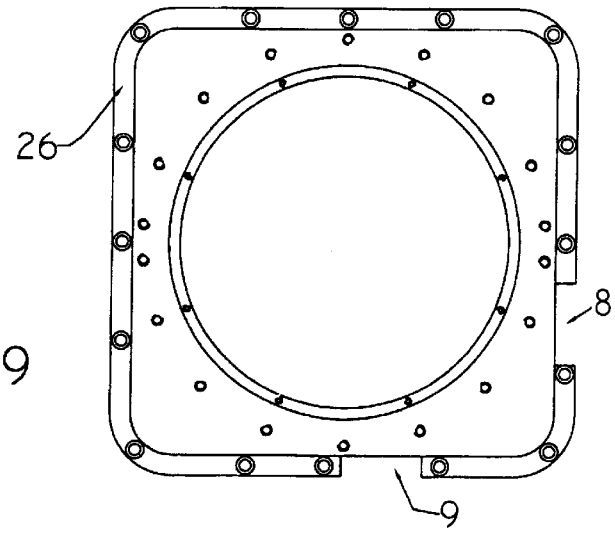
FIG. 9 is a side view of the stator of FIG. 8.
Figure 10:
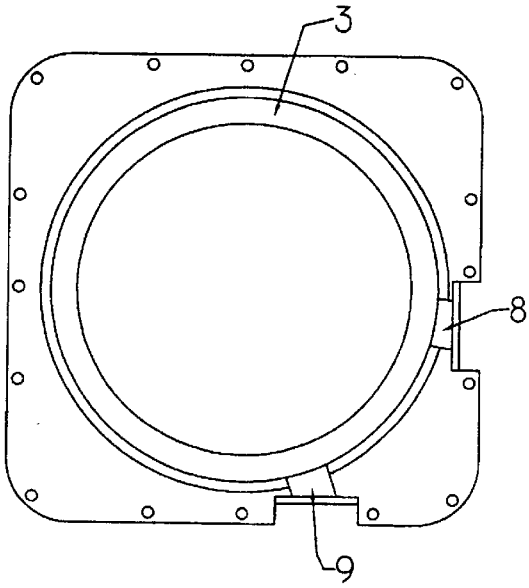
FIG. 10 is a sectional side view, taken along the line III—III of FIG. 8.

As shown in FIGS. 8 to 10, the stator 1, which is characterized in that its internal surface 3 has a spherical profile, is composed of two distinct symmetrical elements which are separated at the central plane III—III of the engine and are joined by the coupling of external flanges 26.

Figure 11:
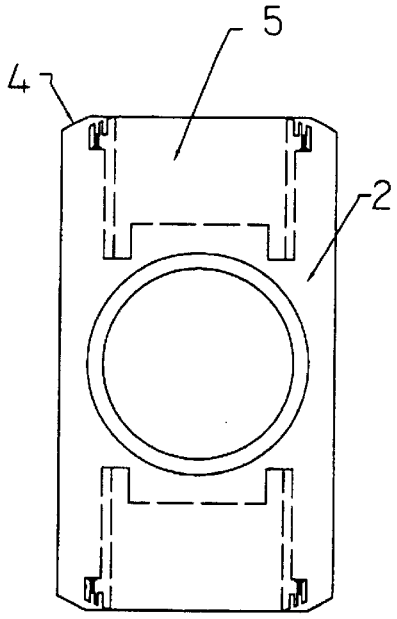
FIG. 11 is a sectional detail view of the rotor.
Figure 12:
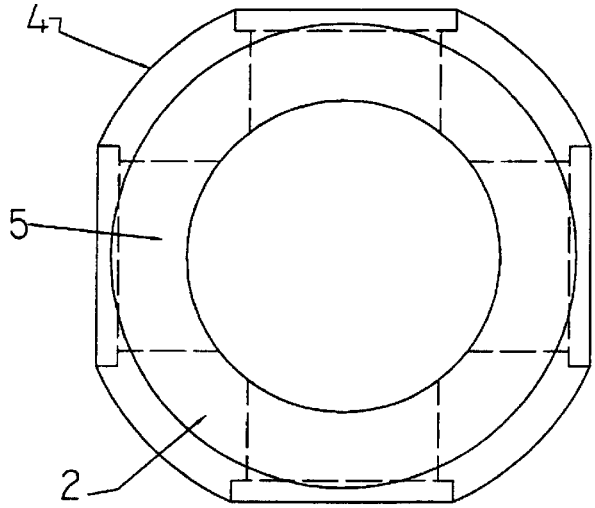
FIG. 12 is a side view of the rotor of FIG. 11.
Figure 13:
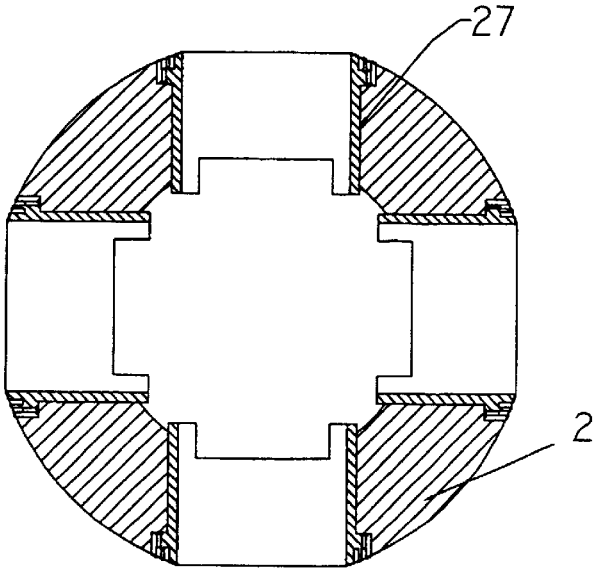
FIG. 13 is a sectional side view of the rotor of FIG. 12.

As shown in FIGS. 11 to 13, the rotor 2, which has a spherical profile, is constituted by a single metallic block on which the liners 27 that form the cylinders 6 are inserted in the four radial opposite cavities 5.

As shown in FIG. 1, the torque obtained by way of the rotation of the rotor 2 is transferred outside the engine by keying onto a hub 28, of at least one of the two lateral flanges 12 of said rotor, a gear 29 which rotationally meshes with external power take-offs, such as the pulley 30 and the gear 34 for engagement of the starter motor and the power distribution of the engine, while through a further flange 31 controls the electronic contact.

The disclosures in Italian Patent Application No. VI2000A000076 from which this application claims priority are incorporated herein by reference.

What is claimed is:

1. A spark ignition rotary internal combustion engine, comprising:

a) a fixed stator having a first port for discharge of burnt products, a second port for aspiration of an air-fuel mixture and a seat for a spark plug;

b) a fixed axial shaft fixedly supported by lateral flanges of said stator;

c) a rotor rotatably supported on said fixed axial shaft for coaxial rotation within said stator, said rotor having the shape of a spherical sector and having equally angularly spaced cylinders radially disposed along the circumference thereof;

d) a piston associated with each of said cylinders in said rotor adapted for reciprocating rectilinear movement in the respective cylinder;

e) an eccentric body having a circular profile fixedly arranged on said axial shaft at a median position thereof and having an axis offset and parallel to said axial shaft, the circular profile of said eccentric body having a bearing surface thereon; and f) a connecting rod associated with each piston having its small end connected to a pin of the respective piston and its big end slideably coupled to the bearing surface of the circular profile of said eccentric body so that as said connecting rod follows through 360° of the circular profile of said eccentric body reciprocating movement is imparted to the respective piston within the respective cylinder, thus continuously varying the volume of the combustion chamber within the cylinder.

2. The spark ignition rotary internal combustion engine as defined in claim 1, wherein the region of contact, with minimum tolerance, between said rotor and said stator has a spherical shape.

3. The spark ignition rotary internal combustion engine as defined in claim 1, wherein said rotor is provided with lateral flanges supported by bearings on said fixed axial shaft.

4. The spark ignition rotary internal combustion engine as defined in claim 1, wherein said fixed axial shaft with the eccentric element is formed by two distinct symmetrical elements, each comprising a shaft portion provided with an eccentric element portion separated at a central plane of the engine and joined by a pin coaxial to the axis of the eccentric element.

5. The spark ignition rotary internal combustion engine as defined in claim 1, wherein the stator has an internal surface which has a spherical profile and is composed of two distinct symmetrical elements separated at a central plane of the engine and joined by virtue of the coupling of the lateral flanges thereof.

6. The spark ignition rotary internal combustion engine as defined in claim 1, wherein the rotor, which is shaped as a spherical sector with two flat faces, comprises a single metallic block in radial cavities of which liners that form the cylinders are inserted.

7. The spark ignition rotary internal combustion engine as defined in claim 3, wherein the torque obtained through rotation of the rotor is transferred outside the engine by keying onto a hub of at least one of the lateral flanges of said rotor a gear which meshes with a pinion which has an axis through which rotates external power take-offs such as a pulley and a gear, in order to operate a starter motor, or a flange that controls an electronic contact.

8. The spark ignition rotary internal combustion engine as defined in claim 1, which comprises four pistons arranged radially on said rotor.

9. The spark ignition rotary internal combustion engine as defined in claim 1, which comprises six pistons arranged radially on said rotor.

* * * * *